US010151492B2

(12) United States Patent
Huang et al.

(10) Patent No.: US 10,151,492 B2
(45) Date of Patent: Dec. 11, 2018

(54) IGNITION CONTROLLING DEVICE OF GAS APPLIANCE

(71) Applicant: GRAND MATE CO., LTD., Taichung (TW)

(72) Inventors: Chung-Chin Huang, Taichung (TW); Chin-Ying Huang, Taichung (TW); Hsin-Ming Huang, Taichung (TW); Hsing-Hsiung Huang, Taichung (TW); Yen-Jen Yeh, Taichung (TW); Kuan-Chou Lin, Taichung (TW); Pen-Liang Liao, Taichung (TW)

(73) Assignee: GRAND MATE CO., LTD., Taichung (TW)

( * ) Notice: Subject to any disclaimer, the term of this patent is extended or adjusted under 35 U.S.C. 154(b) by 813 days.

(21) Appl. No.: 14/521,014

(22) Filed: Oct. 22, 2014

(65) Prior Publication Data

US 2016/0116170 A1 Apr. 28, 2016

(51) Int. Cl.
*F24C 3/12* (2006.01)
*F24C 3/10* (2006.01)
(Continued)

(52) U.S. Cl.
CPC ..... *F24C 3/12* (2013.01); *F23N 5/123* (2013.01); *F23Q 3/008* (2013.01); *F24C 3/103* (2013.01);
(Continued)

(58) Field of Classification Search
CPC ..... F23N 2027/02; F23N 2027/30; F23N 2027/36; F23N 2029/00; F23N 5/123; F23Q 3/008; F24C 3/103; F24C 3/12
See application file for complete search history.

(56) References Cited

U.S. PATENT DOCUMENTS 3,238,423 A * 3/1966 Giuffrida ..... F23N 5/123 307/653
3,405,998 A * 10/1968 Walbridge ..... F23Q 3/00 431/25
(Continued)

FOREIGN PATENT DOCUMENTS

CN 2211015 Y 10/1995
CN 101311631 A 11/2008
(Continued)

OTHER PUBLICATIONS

Examination Report for TW103129872, dated Aug. 19, 2015, Total of 5 page.
(Continued)

*Primary Examiner* — Kenneth Rinehart
*Assistant Examiner* — Logan Jones
(74) *Attorney, Agent, or Firm* — Lynette Wylie; Apex Juris, pllc.

(57) ABSTRACT

An ignition controlling device of a gas appliance includes a high-voltage provider, a controller, and a flame sensor. The gas appliance includes an ignition electrode and a burner, and the ignition electrode is beside burner. The high-voltage provider has an output terminal, and the output terminal is electrically connected to the ignition electrode to provide high-voltage pulses to the ignition electrode. The controller controls the high-voltage provider to provide the high-voltage pulses. The flame sensor is electrically connected to the output terminal of the high-voltage provider to detect a flame around the ignition electrode and the burner. After a flame is detected by the flame sensor, the controller controls the high-voltage provider to stop the high-voltage pulses.

7 Claims, 3 Drawing Sheets

(51) Int. Cl.
*F23N 5/12* (2006.01)
*F23Q 3/00* (2006.01)

(52) U.S. Cl.
CPC ..... *F23N 2027/02* (2013.01); *F23N 2027/30* (2013.01); *F23N 2027/36* (2013.01); *F23N 2029/00* (2013.01)

(56) References Cited

U.S. PATENT DOCUMENTS 3,632,285 A * 1/1972 Foster ..... F23Q 3/004 361/256
3,740,574 A * 6/1973 Taylor ..... F23N 5/123 307/117
3,822,981 A * 7/1974 Walbridge ..... F23N 5/12 431/78
3,836,316 A * 9/1974 Ikegami ..... F23N 5/123 361/170
3,847,533 A * 11/1974 Riordan ..... F23N 5/123 431/71
3,853,455 A * 12/1974 Riordan ..... F23N 5/123 361/170
3,920,376 A * 11/1975 Wyland ..... F23N 5/022 431/69
4,145,180 A * 3/1979 Bendorf ..... F23N 5/123 431/46
4,177,033 A * 12/1979 Wallace ..... F23N 5/123 307/653
4,404,616 A 9/1983 Miyanaka et al.
4,626,193 A * 12/1986 Gann ..... F23N 5/123 340/579
4,872,828 A * 10/1989 Mierzwinski ..... F23N 5/242 431/16
5,636,978 A * 6/1997 Sasaki ..... F23N 5/203 431/18
2012/0288806 A1* 11/2012 Racaj ..... F23N 5/123 431/18

FOREIGN PATENT DOCUMENTS

CN 201281361 Y 7/2009
CN 101545635 A 9/2009
CN 101916967 A 12/2010
DE 3904022 A1 * 8/1989 ..... F23N 5/123
TW M308374 U 3/2007

OTHER PUBLICATIONS

Search Report for TW103129872, dated Aug. 13, 2015, Total of 1 page.
English Abstract for CN2211015, Total of 1 page.
English Abstract for CN101311631, Total of 1 page.
English Abstract for CN101545635, Total of 1 page.
English Abstract for CN101916967, Total of 1 page.
English Abstract for CN201281361, Total of 1 page.
English Abstract for TWM308374, Total of 1 page.
Chinese Office Action for CN2211015Y, dated May 27, 2017, Total of 6 pages.

* cited by examiner

IGNITION CONTROLLING DEVICE OF GAS APPLIANCE

BACKGROUND OF THE INVENTION

1. Technical Field

The present invention relates generally to a gas appliance, and more particularly to an ignition controlling device of a gas appliance.

2. Description of Related Art

FIG. 1 shows a conventional gas appliance 1, which includes a burner 10, an ignition electrode 12, an induction electrode 14, and an ignition controlling device 16. Mixed gas is supplied to the burner 10 and burned. The ignition controlling device 16 is electrically connected to the ignition electrode 12 and the induction electrode 14. The ignition controlling device 16 provides the ignition electrode 12 with high-voltage pulses to let the ignition electrode 12 generate electrical discharges and burn the mixed gas. The induction electrode 14 detects flames of the burner 10, and sends a flame signal to the ignition controlling device 16, and then the ignition controlling device 16 cancels the high-voltage pulses to stop the electrical discharges of the ignition electrode 12.

The conventional gas appliance 1 provides two electrodes 12 and 14 to light the flames and stop ignition. It makes the cost of the conventional gas appliance 1 higher. Besides, the induction electrode 14 is beside the ignition electrode 12, sometime the ignition electrode 12 discharges the electrical discharges to the induction electrode 14. The electrical discharges may burn the ignition controlling device 16 out.

BRIEF SUMMARY OF THE INVENTION

In view of the above, the primary objective of the present invention is to provide an ignition controlling device of a gas appliance, which controls the ignition procedure with single electrode.

The secondary objective of the present invention is to provide an ignition controlling device of a gas appliance, which protects the ignition controlling device from being damaged by the electrical discharges.

An ignition controlling device of a gas appliance includes a high-voltage provider, a controller, and a flame sensor. The gas appliance includes an ignition electrode and a burner, and the ignition electrode is beside burner. The high-voltage provider has an output terminal, and the output terminal is electrically connected to the ignition electrode to provide high-voltage pulses to the ignition electrode. The controller controls the high-voltage provider to provide the high-voltage pulses. The flame sensor is electrically connected to the output terminal of the high-voltage provider to detect a flame around the ignition electrode and the burner. After a flame is detected by the flame sensor, the controller controls the high-voltage provider to stop the high-voltage pulses.

Whereby, with the aforementioned design, the present invention provides single electrode to complete the ignition procedure. It may reduce the cost, and prevent the ignition controlling device from being damaged by high-voltage pulses.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
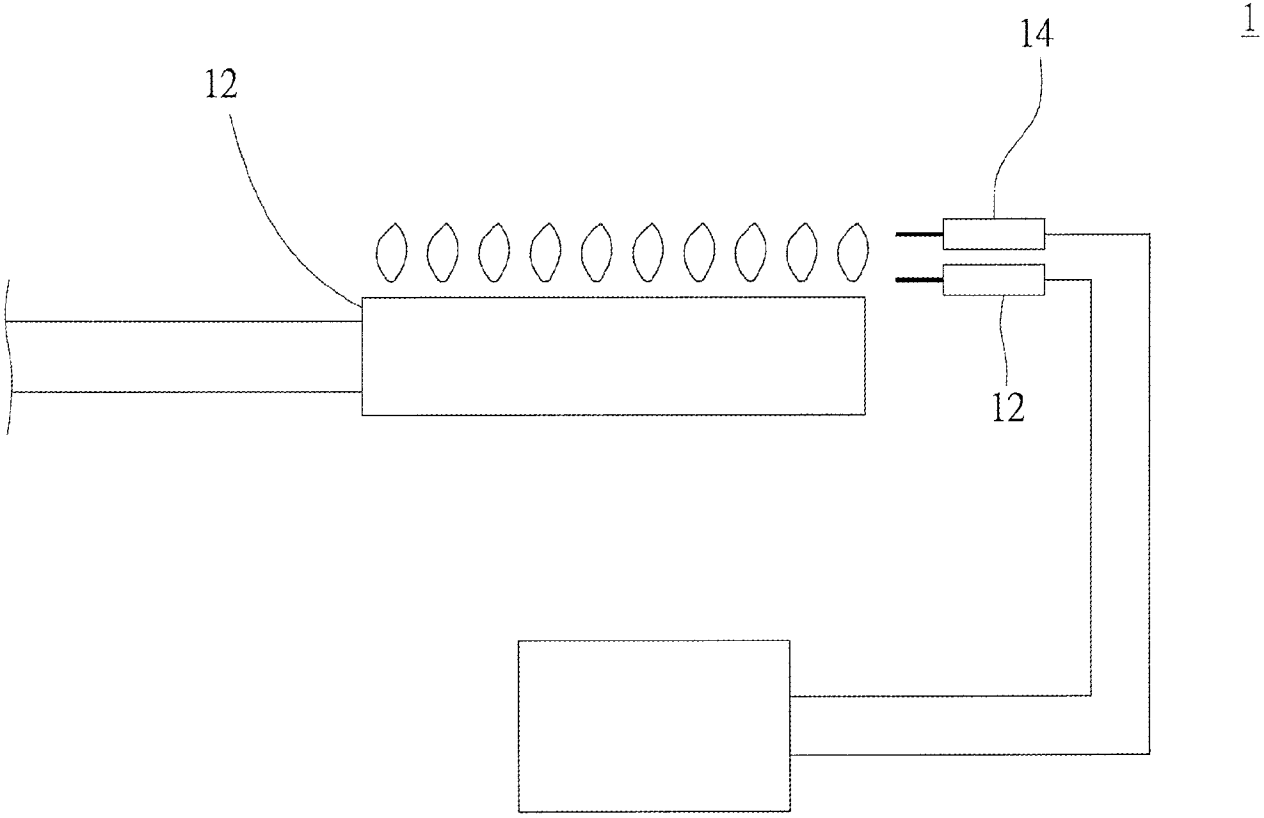
FIG. 1 (PRIOR ART)
FIG. 1 is a schematic diagram of the conventional gas appliance.
Figure 2:
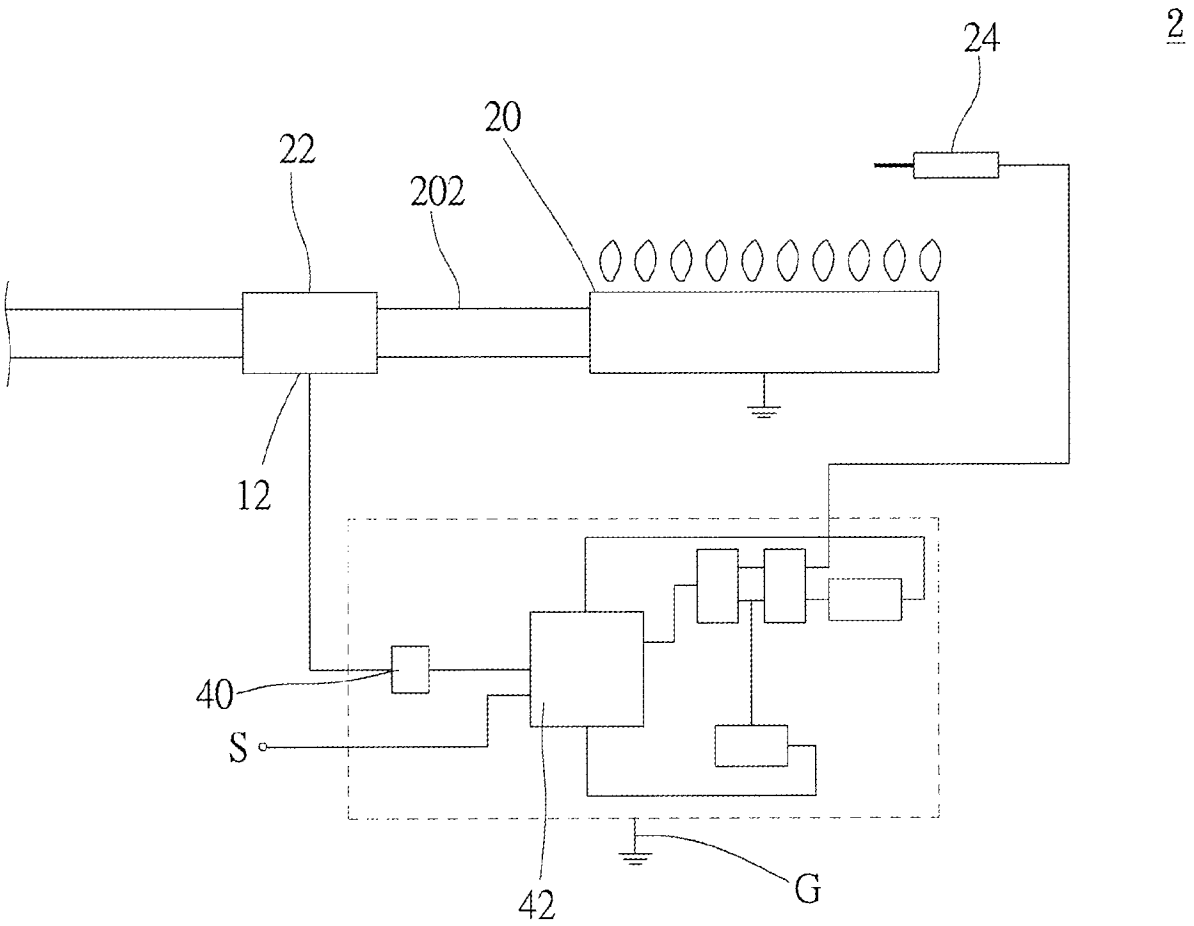
FIG. 2 is a block diagram of the gas appliance of a preferred embodiment of the present invention.

FIG. 2 shows a gas appliance 2 of the preferred embodiment of the present invention, including a burner 20, a gas valve 22, an ignition electrode 24, and an ignition controlling device 26. Mixed gas is burned in the burner 20. The burner 20 is made of metal, and a ground line G of the ignition controlling device 26 is connected to the burner 20. The gas valve 22 is provided on a gas pipe 202 to control a gas flow in the gas pipe 202. The ignition electrode 24 is beside the burner 20, and keeps a distance from it.

Figure 3:
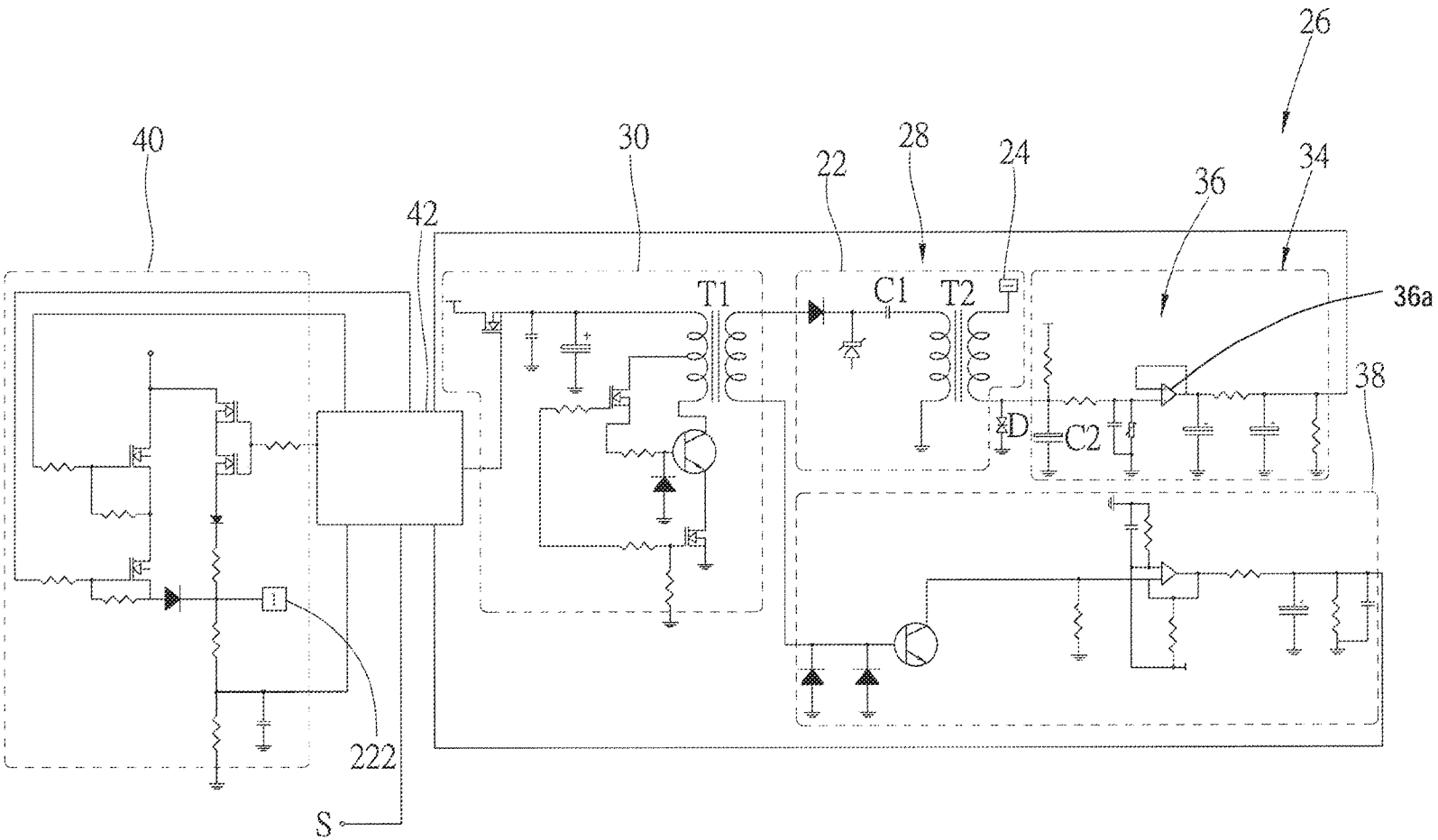
FIG. 3 is a circuit of the ignition controlling device of the preferred embodiment of the present invention.

As shown in FIG. 2 and FIG. 3, the ignition controlling device 26 includes a high-voltage provider 28, a flame sensor 34, a voltage sensor 38, a gas valve controller 40, and a controller, which is a microprocessor 42 in the present invention.

The high-voltage provider 28 includes an oscillation circuit 30, a high-voltage circuit 32, and a starter, which is a DIAC D in the present invention. The oscillation circuit 30 is electrically connected to the microprocessor 42, and includes a step-up transformer T1, which has a secondary side. The oscillation circuit 30 generates oscillating signals under a control of the microprocessor 42 to supply an AC voltage via the secondary side of the step-up transformer T1. The high-voltage circuit 32 is electrically connected to the secondary side of the step-up transformer T1, and includes a discharge transformer T2, which has a secondary side. The secondary side of the discharge transformer T2 is an output terminal of the high-voltage provider 28. The ignition electrode 24 is electrically connected to a first end of the secondary side of the discharge transformer T2. The high-voltage provider 28 receives the AC voltage of the step-up transformer T1 to provide high-voltage pulses via the secondary side of the discharge transformer T2 periodically because of a capacitor C, which is connected to a primary side of the discharge transformer T2. The DIAC D has opposite ends thereof connected to a second end of the secondary side of the discharge transformer T2 and the ground line G of the ignition controlling device 26. The DIAC D conducts current while a voltage difference between the opposite ends is greater than a breakover voltage. At this time, the ignition electrode 24 provides an electrical discharge to the burner 20 to light a flame.

The flame sensor 34 is electrically connected to the second end of the secondary side of the discharge transformer T2 and the microprocessor 42 respectively. The flame sensor 34 includes a capacitor C2 and a buffer circuit 36, wherein the capacitor C2 is electrically connected to the buffer circuit 36, and the buffer circuit 36 is electrically connected to the microprocessor 42. When the flame of the burner 20 touches the ignition electrode 24, the capacitor C2 is charged by a flame signal in the flame, which is generated by plasma effect in the flame, and the buffer circuit 36 sends the microprocessor 42 a signal for the flame being detected after the capacitor C2 reaches a predetermined voltage. The buffer circuit 36 has an operational amplifier 36*a*, which connects the capacitor C2 to the microprocessor 42 and has a low output resistance to eliminate effect of an input resistance of the microprocessor 42 on the voltage of the capacitor C2, so that the microprocessor 42 may precisely and correctly obtain the signal from the capacitor C2.

The voltage sensor 38 detects whether the high-voltage provider 28 is functioning normally or not. In the present embodiment, the voltage sensor 38 is electrically connected to the second end of the secondary side of the step-up transformer T1 and the microprocessor 42 respectively. When the AC voltage is provided via the secondary side of the step-up transformer T1, the voltage sensor 38 receives the AC voltage, and sends a high-level voltage signal to the microprocessor 42 accordingly to be an index of the function of the high-voltage provider 28.

The gas valve controller 40 is electrically connected to the microprocessor 42 and a control terminal 222 of the gas valve 22 to let the gas valve 22 functions under a control of the microprocessor 42.

After the microprocessor 42 receives a start signal S, which is generated by opening a faucet if the gas appliance 2 is a water heater, the ignition controlling device 26 of the present invention will start an ignition procedure, and the ignition procedure includes the following steps:

The microprocessor 42 sends an ignition signal to the oscillation circuit 30 after receiving the start signal S to make the oscillation circuit 30 provide the AC voltage to the high-voltage circuit 32. The high-voltage circuit 32, therefore, outputs the high-voltage pulses via the secondary side of the discharge transformer T2 to conduct the DIAC D, and light a flame in the burner 20 through the ignition electrode 24. Meanwhile, the voltage sensor 38 detects the AC voltage from the oscillation circuit 30, and sends the high-level voltage signal to the microprocessor 42 accordingly. The high-level voltage signal tells the microprocessor 42 that the high-voltage provider 28 functions normally, so the microprocessor 42 controls the gas valve 22 to supply gas to the burner 20.

If the microprocessor 42 does not receive any high-level voltage signal from the voltage sensor 38 in a first time after the ignition signal, it tells that the gas is not burned, so the microprocessor 42 controls the gas valve 22 to stop gas to the burner 20.

Before the gas flows to the burner 20, the ignition electrode 24 keeps discharging. At this time, the flame signal of the flame charges the capacitor C2 until the voltage of the capacitor C2 reaches the predetermined voltage, and then is sent to the microprocessor 42 through the buffer circuit 36. After receiving the predetermined voltage, the microprocessor 42 stops the ignition signal to make the oscillation circuit 30 stop to provide the high-voltage pulses, and the ignition procedure is completed.

If the gas valve 22 is opened, and the microprocessor 42 does not receive any voltage from the flame sensor 34 in a second time, the microprocessor 42 controls the gas valve 22 to stop gas to the burner 20 to prevent leakage of gas.

In conclusion, the ignition controlling device 26 only has one electrode 24 for the entire ignition procedure. It has a lower cost, and no problem of the ignition controlling device 26 being damaged by the discharge of the ignition electrode 24. It is noted that the starter is conducted while the high-voltage pulses are outputting that may avoid the voltage of the high-voltage pulses from going back to the microprocessor 42 through the flame sensor 34 to damage the microprocessor 42. In practice, the starter may be formed by Shockley diode and/or transistor, which have a breakover voltage lower than the voltage of the high-voltage pulses and higher than the predetermined voltage of the capacity C2.

It must be pointed out that the embodiments described above are only some preferred embodiments of the present invention. All equivalent methods which employ the concepts disclosed in this specification and the appended claims should fall within the scope of the present invention.

What is claimed is:

1. An ignition controlling device of a gas appliance, wherein the gas appliance includes an ignition electrode, a burner and a gas valve; the ignition electrode is beside the burner; the gas valve is disposed on a gas pipe connected to the burner; the gas valve controls a gas flow of the gas in the gas pipe; the ignition controlling device comprising:

a high-voltage provider including an oscillation circuit and a high-voltage circuit, wherein the oscillation circuit includes a step-up transformer; the step-up transformer has a secondary side, and the secondary side is electrically connected to the high-voltage circuit; the high-voltage circuit has an output terminal, wherein the output terminal is electrically connected to the ignition electrode to provide high-voltage pulses to the ignition electrode;

a controller electrically connected to the oscillation circuit for controlling the step-up transformer to provide the high-voltage circuit with an AC voltage via the secondary side and the high-voltage circuit to provide the high-voltage pulses;

a flame sensing circuit electrically connected to the output terminal of the high-voltage provider to detect a flame around the ignition electrode and the burner;

a voltage sensing circuit electrically connected to the controller and the secondary side of the step-up transformer, wherein the voltage sensing circuit outputs a voltage signal to the controller and the controller controls the gas valve to supply the gas to the burner after detecting the AC voltage from the secondary side of the step-up transformer; the controller outputs a start signal to the oscillation circuit to control the high-voltage circuit to generate the high-voltage pulse; when the controller does not receive the voltage signal after outputting the start signal for a predetermined time period, the controller stops the gas valve for supplying the gas; wherein after a flame is detected by the flame sensing circuit, the controller controls the high-voltage provider to stop the high-voltage pulses.

2. The ignition controlling device of claim 1, wherein the high-voltage provider has a discharge transformer, and the discharge transformer has a secondary side; the secondary side of the discharge transformer is the output terminal of the high-voltage provider; and the secondary side of the discharge transformer is electrically connected to the ignition electrode and the flame sensing circuit respectively.

3. The ignition controlling device of claim 2, wherein the high-voltage provider has a starter; the secondary side of the discharge transformer has opposite ends electrically connected to the ignition electrode and a first end of the starter; a second end of the starter is electrically connected to a ground line of the ignition controlling device; the starter is conducted while the discharge transformer provides the high-voltage pulses via the secondary side.

4. The ignition controlling device of claim 3, wherein the starter has a DIAC.

5. The ignition controlling device of claim 3, wherein the flame sensing circuit has a capacitor; when the flame of the burner touches the ignition electrode, a flame signal generated by the flame to charge the capacitor; and when a voltage of the capacitor reaches a predetermined voltage, the controller controls the high-voltage provider to stop the high-voltage pulses.

6. The ignition controlling device of claim 5, wherein the flame sensing circuit further includes a buffer circuit; the buffer circuit includes an operational amplifier; the buffer circuit and the controller are electrically connected with the operational amplifier.

7. The ignition controlling device of claim 3, wherein the controller includes a microprocessor.

* * * * *